US005636855A

United States Patent [19]

Couderc et al.

[11] Patent Number: 5,636,855

[45] Date of Patent: *Jun. 10, 1997

[54] APPARATUS FOR MODIFYING THE PRESSURE DISTRIBUTION OF A SKI ALONG ITS SLIDING SURFACE

[75] Inventors: Bernard Couderc, Annecy; Pierre Szafranski, Pringy, both of France

[73] Assignee: Salomon S.A., Metz-Tessy, France

[ * ] Notice: The term of this patent shall not extend beyond the expiration date of Pat. No. 5,332,253.

[21] Appl. No.: 244,197

[22] PCT Filed: Sep. 10, 1992

[86] PCT No.: PCT/FR92/00851

§ 371 Date: May 25, 1994

§ 102(e) Date: May 25, 1994

[87] PCT Pub. No.: WO93/11838

PCT Pub. Date: Jun. 24, 1993

[30] Foreign Application Priority Data

Dec. 11, 1991 [FR] France ..... 91 15612

[51] Int. Cl.[6] ..... A63C 5/06

[52] U.S. Cl. ..... 280/602; 280/607; 280/634

[58] Field of Search ..... 280/602, 607, 280/617, 618, 633, 634, 636

[56] References Cited

U.S. PATENT DOCUMENTS

| | | | |
|---|---|---|---|
| 3,260,531 | 7/1966 | Heuvel | 280/602 |
| 3,963,253 | 6/1976 | Rieger | 280/617 |
| 4,061,356 | 12/1977 | Salomon | 280/618 |
| 4,230,338 | 10/1980 | Weigl et al. | 280/618 |
| 4,896,895 | 1/1990 | Bettosini | 280/607 |
| 5,129,668 | 7/1992 | Hecht | 280/618 |
| 5,135,250 | 8/1992 | Abondance et al. | 280/617 |
| 5,332,253 | 7/1994 | Couderc et al. | 280/602 |

FOREIGN PATENT DOCUMENTS

| | | | |
|---|---|---|---|
| 346743 | 11/1978 | Austria | A63C 9/00 |
| 1270867 | 6/1990 | Canada | A63C 5/00 |
| 0182776 | 5/1986 | European Pat. Off. | A63C 9/00 |
| 0183586 | 6/1986 | European Pat. Off. . | |
| 0230989 | 8/1987 | European Pat. Off. | A63C 9/00 |
| 0409749 | 1/1991 | European Pat. Off. . | |
| 567780 | 11/1993 | France | 280/618 |
| 3602364 | 7/1987 | Germany | A63C 5/06 |
| 4101997 | 9/1991 | Germany | A63C 9/00 |
| 8303360 | 10/1983 | WIPO | 280/602 |
| WO93/15797 | 8/1993 | WIPO | A63C 9/00 |

OTHER PUBLICATIONS

English language abstract for German Patent Publication No. 4,101,997.

English language abstract for German Patent Publication No. 3,602,364.

English language abstract for European Patent Publication No. 0,182,776.

*Primary Examiner*—Brian L. Johnson

*Assistant Examiner*—Min Yu

*Attorney, Agent, or Firm*—Greenblum & Bernstein P.L.C.

[57] ABSTRACT

A device for distributing the pressure of a ski, such as an alpine ski, over its gliding surface. The device includes at least one support element for supporting the sole of a boot, which is affixed to the ski by front and rear binding elements. A sensor element of the device is arranged for contact with the sole of the boot for capturing vertical forces of the boot during skiing. Front and rear flexion elements are positioned for transmitting respective flexion moments to the front and rear of the ski in response to the exertion of such vertical forces from the boot.

35 Claims, 7 Drawing Sheets

APPARATUS FOR MODIFYING THE PRESSURE DISTRIBUTION OF A SKI ALONG ITS SLIDING SURFACE

BACKGROUND OF THE INVENTION

1. Field of the Invention

The invention is related to a device for modifying the pressure distribution of a ski, particularly such as an alpine ski, along its gliding surface. The invention is also related to an assembly of front and rear alpine ski binding elements, as well as an alpine ski.

2. Discussion of Background and Relevant Information

Skis used for alpine skiing are constituted by relatively long beams on which the skier's boots are retained by front and rear binding elements. The boots and binding elements are located approximately in the median zone of the ski, which is commonly known as the middle sole.

The ski itself possesses a natural arch when at rest, whereby the middle sole is naturally raised with respect to the front end of the ski, or shovel, and the rear end of the ski, or tail. In addition, the ski possesses a flexibility. While skiing, the ski deforms elastically in response to the various biases it is subjected to from the skier, but also from the terrain over which it glides.

The main bias to which the ski is subjected is constituted by the weight of the skier, and by the reaction to which the gliding surface subjects the ski.

The ski is also biased by the binding elements. In fact, it is known that the binding elements pinch the boot longitudinally. To do this, the rear binding element is generally slidably mounted, and it is elastically returned frontwardly by springs which are commonly known as return springs. The reaction to this pinching action is transmitted by the binding elements to the ski. However, this reaction differs in nature depending upon the mode of assembly of the rear binding element to the ski. Indeed, certain rear binding elements are assembled directly to the ski, whereas others are connected to the front binding element by a non-extensible link, such as a metallic blade that extends beneath the boot.

The ski is also influenced by the position of the skier on his or her boots, depending upon whether the skier carries his or her weight towards the front or towards the rear.

It is known that one can modify the behavior of the ski on the snow, especially its ease of turn initiation, its operational quality in turns and in straight lines, by influencing the arch of the ski, or else by playing with the longitudinal pressure distribution of the ski on the snow. By playing with this pressure distribution, it is known that one can render the ski more or less pivotal or more or less guiding, i.e., one can promote its ability to turn easily, and to provide considerable operational stability. For skis currently on the market, pressure distribution of the ski on the snow is determined mainly by the internal structure of the ski and by the assembly mode of the binding elements to the ski, i.e, with or without the connection blade between the front and rear elements. The pressure distribution can also be influenced by the thrust intensity provided to the return spring.

There are devices with attached elements that enable the pressure distribution of the ski on the snow to be modified. As such, European Patent Application No. 183 586 describes a blade of elastic material attached above the ski, between the binding elements and the ski. In the area of its front end and its rear end, this blade has cursors by means of which a portion of the forces to which the ski is subject are transmitted vertically. However, this device has the disadvantage of mediocre performance with a substantial space requirement. It is adapted for the case where both feet of the skier are in support on the same ski, so as to avoid the entire weight of the skier from being concentrated in the middle sole zone. On the contrary, it would be maladapted in the case of a pair of conventional skis.

In European Patent Application No. 409 749 a device is disclosed that is constituted by a plate, raised with respect to the upper surface of the ski, maintained between two longitudinal abutments. Elastic shock absorption means are inserted between the plate and the abutments, and the pre-stress exerted on these elastic means is adjustable. The bindings are mounted on the plate. This device provides good results, but its disadvantage is that the plate is raised with respect to the ski along its entire length. Therefore, it behaves like a stiffener for the ski, and because of this, it disturbs the flexional movements of the ski. In addition, the plate induces an identical pre-stress on the ski towards the front and rear of the middle sole.

It must also be noted that these known devices induce a static-type modification of the pressure distribution on the ski, i.e., this induced modification is not influenced by the position of the skier on his or her skis during the glide.

German Patent Application 41 01 997 describes a ski equipped with a support plate which bears the front and rear binding elements. The support plate is connected to the ski by journals or connecting rods, and a layer of shock absorbing material is inserted between the plate and the ski.

This device enables a free flexion of the ski in the zone of the boot, i.e., it reduces the disturbances that the boot and the binding elements generate on the flexion of the ski. Therefore, this device does not exert any motive or directive action on the flexion of the ski.

SUMMARY OF THE INVENTION

One of the objects of the invention is to propose a device which enables the pressure distribution on the ski over its gliding surface to be modified dynamically, i.e., a device that takes into account the position of the skier on his or her skis and the vertical thrust force of the skier on the skis.

Another object of the invention is to propose a device that further provides a suspension effect to the skier with respect to the skis.

Another object of the present invention is to propose a device that has a reduced space requirement.

Another object of the present invention is to propose a device that influences the pressure distribution of the ski on the snow on the front end of the ski, as well as on the rear end of the ski.

Other objects and advantages of the present invention will become apparent in the course of the following description, this description however, being provided as a non-limiting example.

The device according to the invention distributes the pressure of the ski over its gliding surface. The ski is equipped with front and rear binding elements intended to retain the ends of a boot. The device has at least one support element on which the sole of the boot rests.

The device further includes:

- a sensor element, adapted to capture the vertical biases of the boot on the ski;
- front and rear flexion means for generating a flexional moment on the two front and rear ends of the ski, in response to a vertical bias of the boot; and linking means between the sensor element and the front and rear flexion means for transmitting to the flexion means at least a portion of the vertical biases of the boot on the ski, captured by the sensor element.

BRIEF DESCRIPTION OF THE DRAWINGS

The invention will be better understood with reference to the description below, as well as the annexed drawings which form an integral portion thereof.

DETAILED DESCRIPTION OF THE PREFERRED EMBODIMENTS

Figure 1:
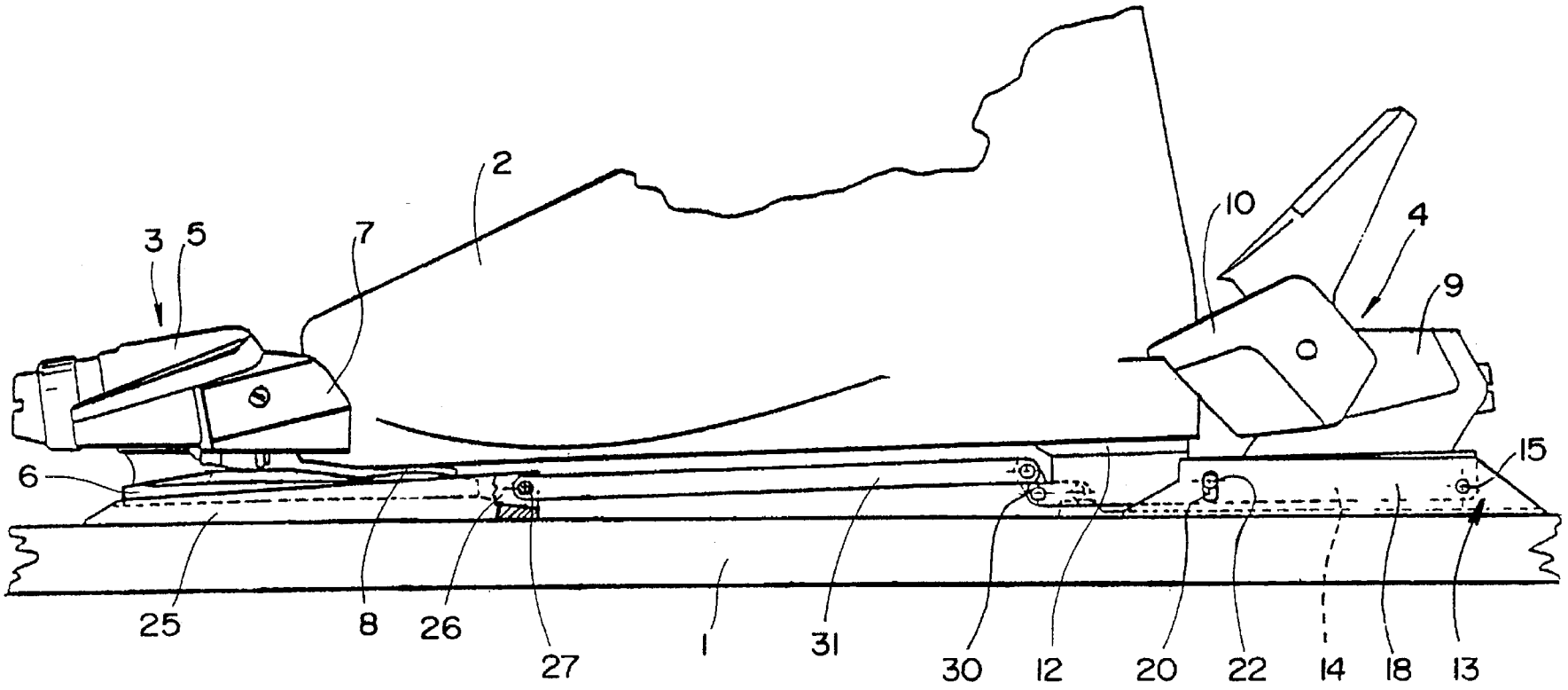
FIG. 1 represents a side elevation view of a ski in the middle sole zone, equipped with the device according to a non-limiting embodiment of the invention, and two front and rear binding elements.

FIG. 1 represents a side view of an alpine ski 1 in its middle sole zone. A boot 2 is retained on the ski by a front binding element 3 and a rear binding element 4. Both binding elements are connected to the ski by means which will be described hereinafter. These elements are of any appropriate type and, in the illustrated example, front binding element 3 has a body 5, mobile with respect to a base 6, against the elastic return force of a spring which is not visible in the drawing. Body 5 further bears a retention element 7 of the front end of boot 2. Furthermore, base 6 is extended rearwardly by a support element 8 on which the front end of the sole of the boot rests. Naturally, any other appropriate type of front binding element could also be suitable.

Rear binding element 4 has a body 9 which itself bears a retention element 10 for the rear end of boot 2. The retention element 10 is mobile against the elastic return force of a spring which is not visible in the drawing. Likewise, body 9 is longitudinally mobile along a slide 14 against the elastic return force of a spring which brings it back towards the front, such that boot 2 is pinched along a longitudinal direction between front element 3 and rear element 4. This is well known by one of ordinary skill in the art. In addition, rear binding element 4 has a rear support element 12 on which the rear end of the boot rests.

According to the invention, the ski is equipped with a device that is intended to control the pressure that the ski exerts over its gliding surface, or more precisely, to control the pressure distribution of the ski over its gliding surface depending on the biases to which the boot subjects the ski.

This device mainly comprises a sensor which is adapted to capture the vertical biases of the boot. Preferably, this sensor captures the biases of one end of the boot and, because of this, it especially reacts to a change in pressure, position and equilibrium of the skier with respect to his or her boots.

The device further comprises front and rear flexion means that generate flexional moments in response to the biases captured by the sensor, in the area of the base of the front binding element, and in the area of the rear binding element.

Finally, the device comprises linking means between the sensor and the flexion means for transforming a downward vertical bias of the boot into flexional moments which tend to make the front and rear ends of the ski plunge towards the gliding surface.

Figure 3:
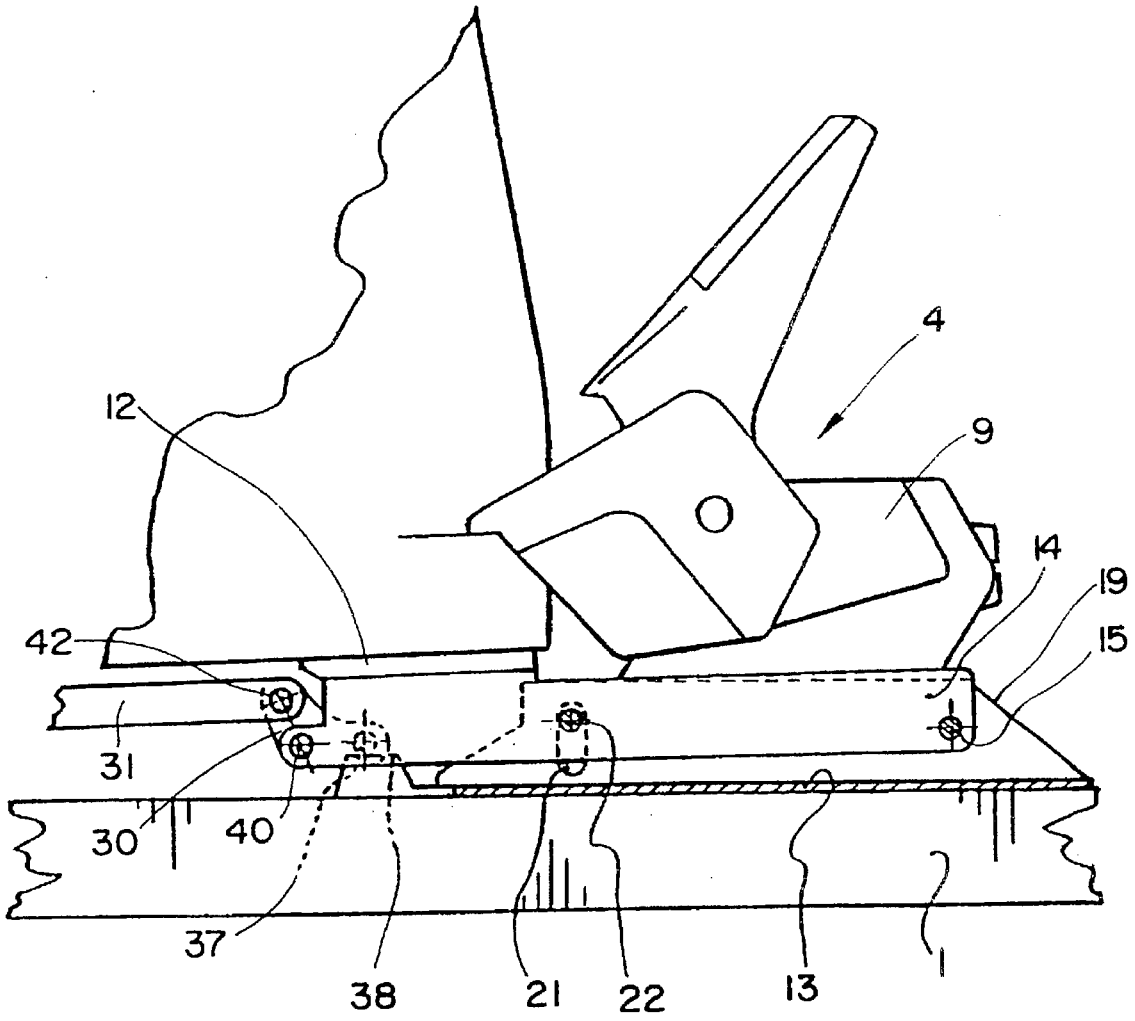
FIG. 3 is a partial sectional side elevation view of the rear portion of the assembly represented in FIG. 1.

In the embodiment represented in the drawing, the sensor is vertically mobile and is constituted by rear support element 12 of rear binding element 4. With reference to FIG. 3, it is visible that in the area of rear binding element 4, a base plate 13 is fixedly assembled to the upper surface of the ski by any appropriate means, for example, by screws. Furthermore, body 9 of rear binding element 4 is slidably mounted with respect to a slide 14 which can tip with respect to base plate 13 about a journal axle 15 located in the rear portion of slide 14 and base plate 13. Furthermore, journal axle 15 is raised substantially with respect to the upper surface of the ski. The reason for this will be explained hereinafter.

Support element 12 extends slide 14 frontwardly, and constitutes a one-piece assembly with this slide.

Preferably, there are means to control and guide the pivoting movement of slide 14. In the illustrated example, base plate 13 includes two longitudinal wings 18 and 19 positioned laterally of the slide 14. The rear portion of these wings 18 and 19 bears journal axle 15. In the front portion, wings 18 and 19 have a slot 20, 21 oriented substantially vertically. A transversely oriented pin 22 is fixedly connected to slide 14. This pin crosses each of slots 20 and 21, and its ends rotate in these slots. These slots thus provide slide 14 with a downwardly vertical abutment and an upwardly vertical abutment.

As previously mentioned, the sensor is constituted by support element 12 which is fixedly connected to slide 14, and therefore accompanies the slide in its pivoting movement about axis 15. In addition, the support element can be coated with any appropriate material, intended to facilitate the sliding of the boot's sole in view of its release.

It can also constitute the support column of a conventional-type brake. This brake is not represented in the drawings.

In the area of rear binding element 4, the device according to the invention also comprises flexion means which are adapted to induce a flexional moment on the rear end of the ski. With reference to FIG. 3, the flexion means are constituted by rear base plate 13, which is affixed to the surface of the ski, and which further has the journal axis 15 of the slide in the area of its rear end. It is to be understood that a horizontal rearward thrust exerted on axis 15 induces a flexional moment on the ski that tends to make the tail of the ski plunge towards its gliding surface.

Figure 2:
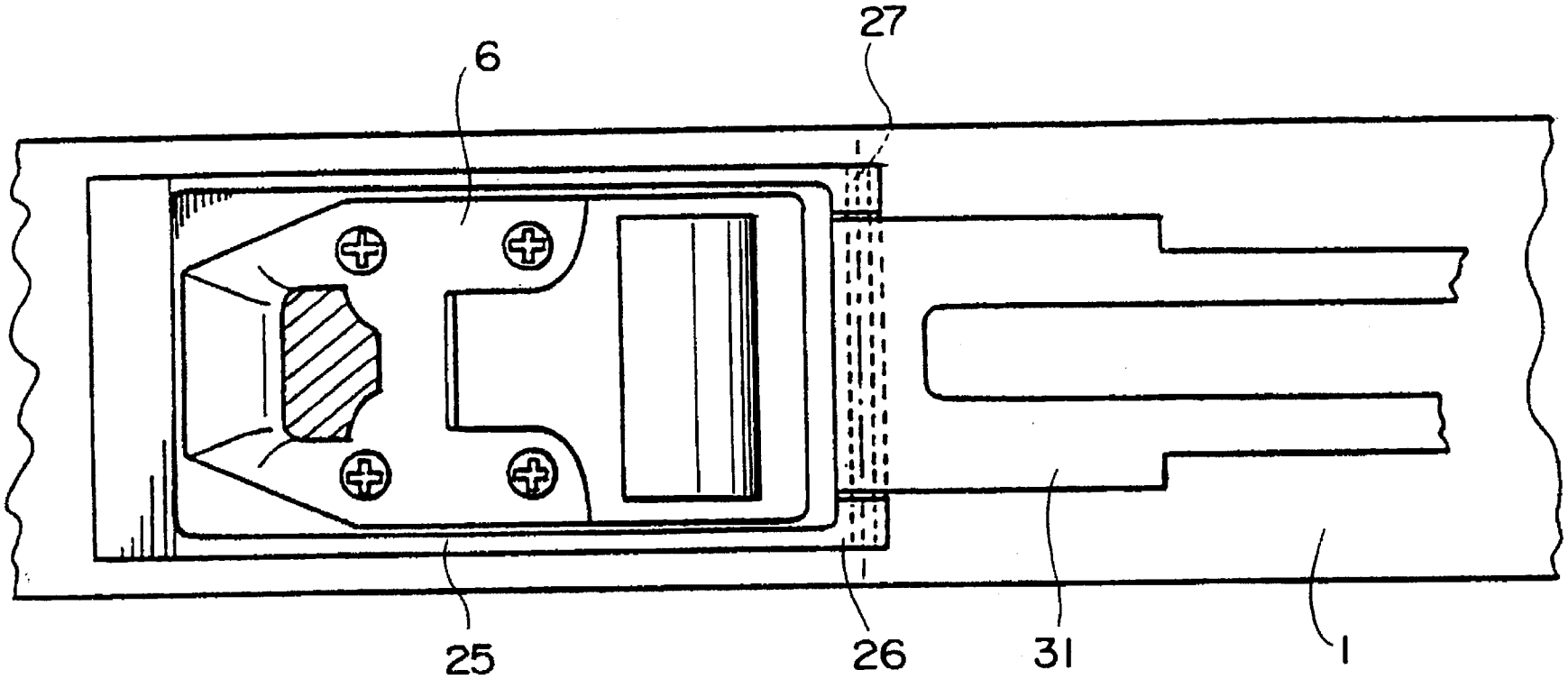
FIG. 2 is a top plan view of the assembly represented in FIG. 1, more specifically of the front portion of this assembly.

The device further comprises front flexion means. With more specific reference to FIGS. 1 and 2, these means comprise a front base plate 25, which is affixed to the ski by any appropriate means, and for example, by screws. This front base plate 25 is inserted between base 6 of front binding element 3 and the upper surface of the ski. In its rear portion, front base plate 25 has a free end 26, raised with respect to the ski, where one can specifically see an axle 27 whose role will be described hereinafter.

A frontward horizontal thrust exerted on base plate 25 in the area of axle 27 induces a flexional moment in the area of the ski by means of base plate 25, such flexional moment tending to make the front end of the ski plunge towards its gliding surface.

In addition, the device according to the invention comprises linking means between sensor 12 and the front 25 and rear 13 flexion means, for transmitting thrust forces to the flexion means, resulting from the vertical bias of the boot captured by sensor 12.

With reference to FIG. 1, the linking means mainly comprise a pivot element 30, a front compression bar 31 which connects the pivot element to front base plate 25, and a rear compression bar which similarly connects pivot element 30 to rear base plate 13, and which here is constituted by slide 14 and its front extension 12.

Front compression bar 31 is connected to front base plate 25 by journal axis 27. This compression bar is of any appropriate type, and it is adapted to transmit a frontward longitudinal thrust to axis 27. It can be, for example, a rigid bar made of metal or plastic material.

Similarly, the rear compression bar, which is constituted by slide 14, is connected to rear base plate 13 by journal axle 15, which also forms the pivot axis of the slide. This rear compression bar is rigid and it is adapted to transmit a rearward longitudinal thrust to base plate 13 by means of axle 15.

Figure 4:
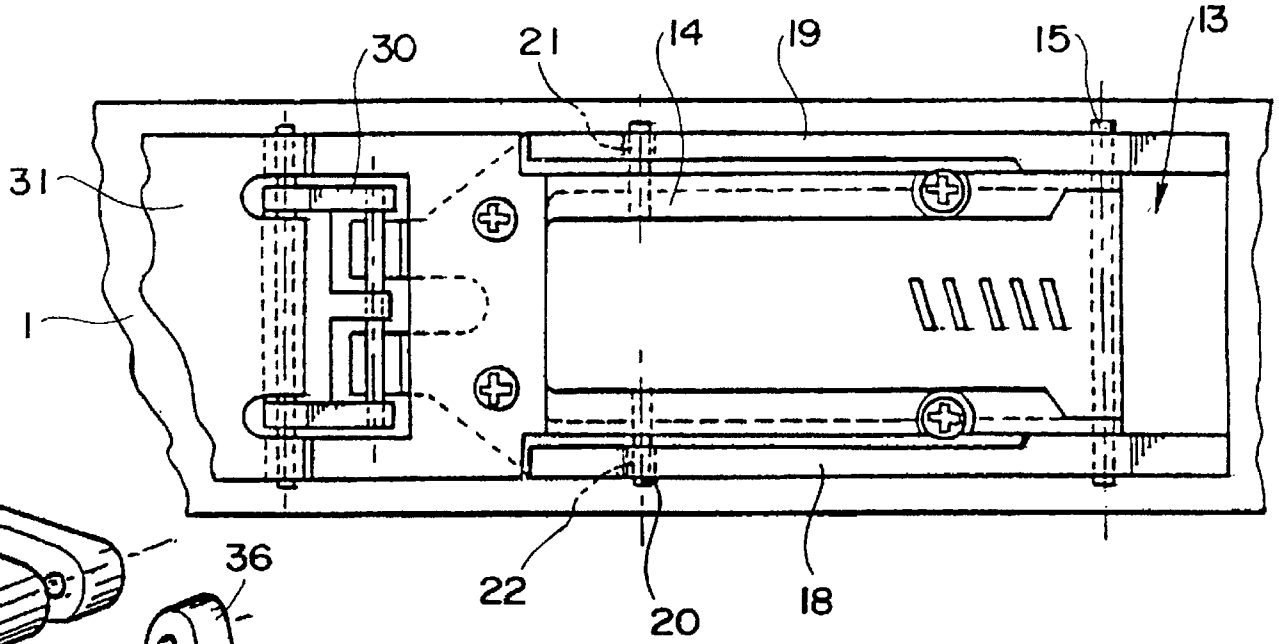
FIG. 4 is a top plan view of the device represented in FIG. 3.
Figure 5:
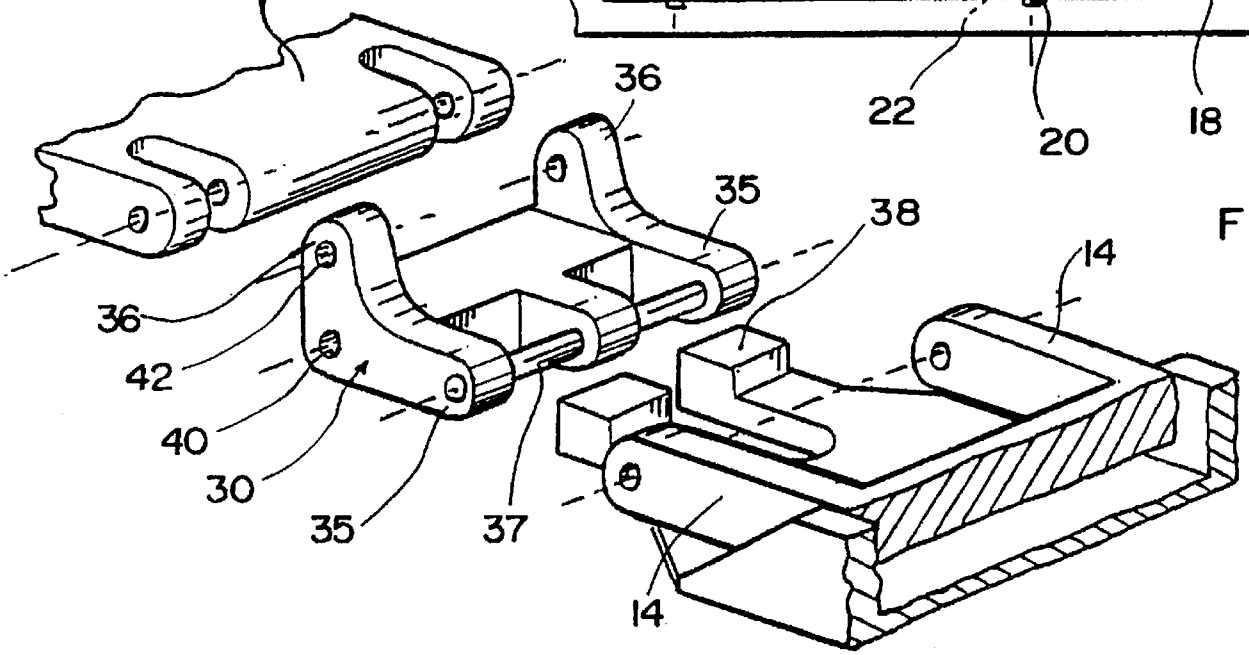
FIG. 5 is an exploded perspective view of the elements visible in FIGS. 3 and 4.

The connection between pivot element 30 and the front and rear compression bars is more clearly visible in FIGS. 3 to 5. Seen from the side, pivot element 30 has an L-shape. In the illustrated example, pivot element 30 has a rearwardly oriented horizontal arm 35, and a vertical arm 36. The free end of horizontal arm 35, in the form of a transverse pin 37, is in support against a spacer 38 affixed to the upper surface of the ski. As represented in the drawings, spacer 38 can be constituted by a frontward extension of rear base plate 13.

The rear compression bar, constituted by slide 14, is connected to pivot element 30 in the area of a journal axle 40 which is located in the central portion of the pivot element. Similarly, front compression bar 31 is connected to pivot element 30 in the area of a transverse journal axle 42 located in the upper portion of vertical wing 36.

In the area of pivot element 30, the various elements are arranged such that a downward pivot of slide 14 causes a rotation of pivot element 30 in the counterclockwise direction, the pivot element taking support on spacer 38 by means of its pin 37. This rotation of the pivot element causes journal axles 40 and 42 to be displaced along a substantially horizontal direction, axle 42 being displaced towards the front, and axle 40, in reaction, being displaced towards the rear. The displacement amplitude of each of axles 40 and 42 is determined by the vertical position of axles 40 and 42 with respect to pin 37, and the distance between these axles and pin 37.

The intensity of each of the frontwardly and rearwardly transmitted thrusts, and therefore of each of the flexional moment induced, is dependent upon these parameters.

It must be emphasized that thrust forces F1 and F2 induced by force F in the front 31 and rear 14 compression bars have the same magnitude, but are not a priori equal.

The relationship linking them depends upon the relative position of the three elements, axles 40, 42 and pin 37, as well as the inclination with respect to the horizontal line of the segments demarcated in the diagram of FIG. 1, on the one hand, by axles 27 and 42, on the other hand, by axles 40 and 15. This inclination varies with the rotation of the pivot element.

The aforementioned device operates in the following manner. In one of these extreme positions which is represented in FIGS. 1 and 3, the ski induces a light, horizontally oriented pre-stress in the compression bars, in the direction of the pivot element. This resting pre-stress tends to make the pivot element tip in the clockwise direction, which drives slide 14 and sensor 12 in an upward position with respect to axle 15.

Figure 6:
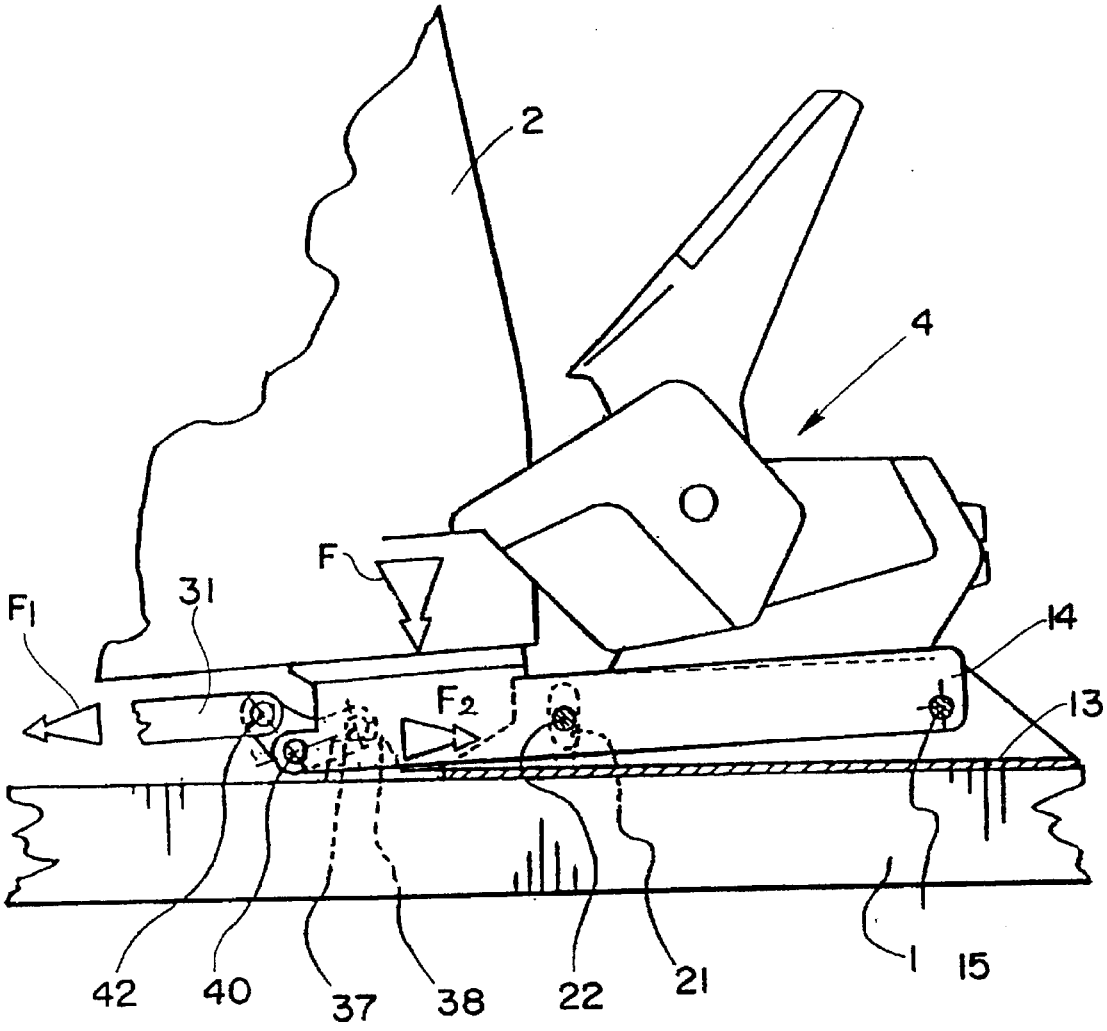
FIG. 6 is a side elevation view of the rear portion of the device, and illustrates the operation of the device.

From this position, if the skier carries his or her weight on the rear of his or her boots, a downward vertical bias F is transmitted by the boot to sensor 12. This downward vertical bias tends to make slide 14 pivot about its axle 15 in the counterclockwise direction. This pivot causes the pivot of pivot element 30 about its support pin 37, also in the counterclockwise direction. In the area of front compression bar 31 and rear slide 14, the pivot element generates two horizontal forces F1 and F2 oriented respectively towards the front and rear of the ski. These forces are transmitted respectively to journal axle 27 of front compression bar 31, at front base plate 35, and, on the other hand, to journal axle 15 of slide 14 at base plate 13. These forces F1 and F2 in turn generate two flexional moments in the area of front base plate 25 and rear base plate 13, which tend to make the front end and rear end of the ski plunge in the direction of the gliding surface. The downward movement of sensor 12, and the pivoting movement of slide 14 can be produced until transverse pin 22, which crosses slide 14, arrives in downward abutment in slots 20 and 21. FIG. 6 represents the device in the area of the rear binding element in its extreme low position.

When bias F has ceased, the device returns to its resting position, i.e., the position of pivot element 30 and slide 14, which is represented in FIG. 3.

Thus, an increase in the vertical thrust that the boot exerts downwardly on rear support element 12 is transmitted to the ski in the form of flexional moments which tend to make the front end and rear end of the ski plunge. These flexional moments transfer a portion of the vertical pressure that the ski exerts on its gliding surface towards the front and rear of the ski, and which pressure, without action by the device, would be concentrated in the tail zone.

Such a dynamic modification of the pressure distribution of the ski on the snow modifies the behavior and operation of the ski, especially in the various phases of a turn, during which the skier displaces his or her weight with respect to his or her boots.

The device according to the invention benefits from the flexibility of the ski in order to send, towards the front and the rear, a portion of the vertical biases that the boot transmits to the ski in the middle sole zone.

Figure 7:
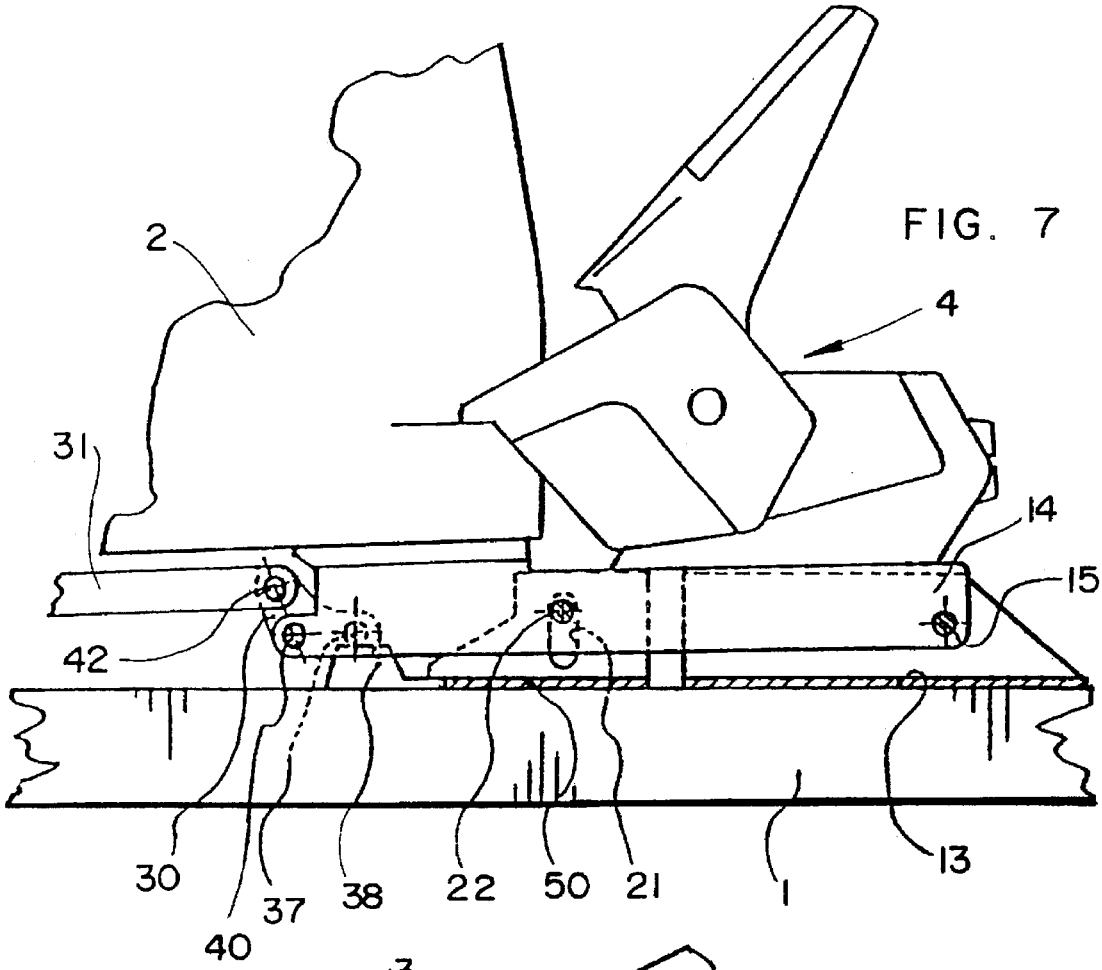
FIG. 7 represents a side elevation view of the rear portion of the assembly of FIG. 1 according to an embodiment variation.

FIG. 7 illustrates a variation of the aforementioned device, according to which spacer 38, on which pin 37 of pivot element 30 takes support, is no longer affixed to rear plate 13, but is affixed to the ski by means of an element 50, independent of rear base plate 13. This arrangement enables the flexion of the rear portion of the ski to be released. Indeed, the ski can bend between rear plate 13 and spacer 38.

Figure 8:
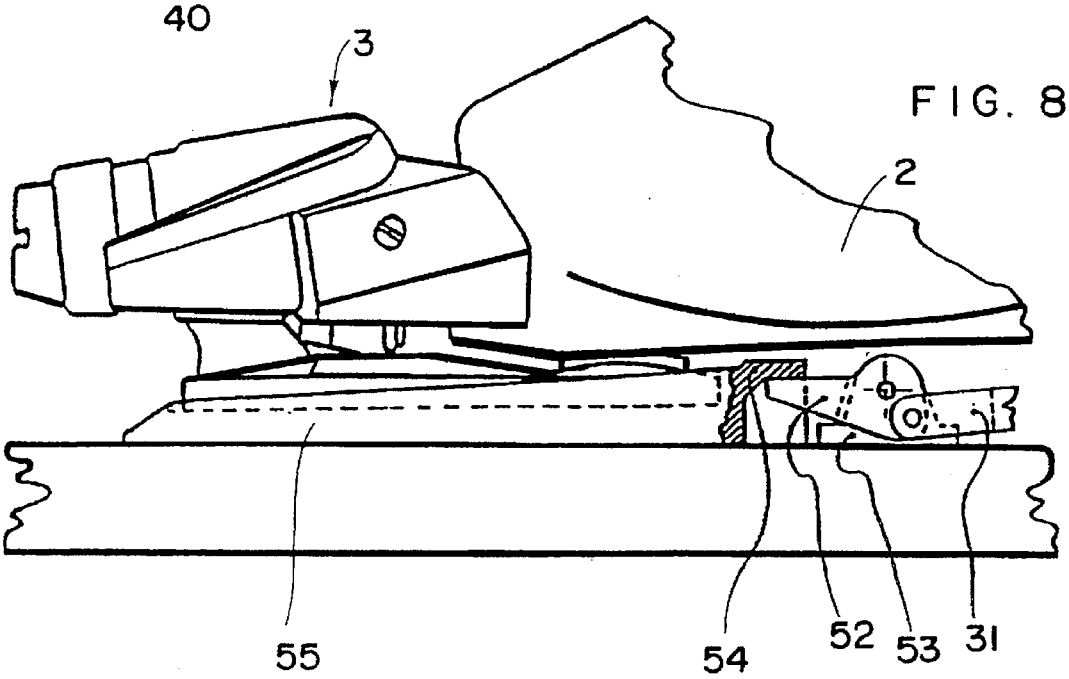
FIG. 8 represents a side elevation view of the front portion of the assembly of FIG. 1 according to an embodiment variation.

FIG. 8 illustrates a variation of the device in the area of the connection between front compression bar 31 and base plate 55 of front element 3. In this drawing, this connection is made by means of a pivot element 52, journalled about a transverse axis with respect to a support 53 affixed to the ski. The free front end of pivot element 52 is in support beneath an edge 54 that front base plate 25 has in its rear portion. The frontward horizontal thrust which is transmitted by compression bar 31 is transformed by the pivot element into an upward vertical bias which is exerted beneath edge 54 of base plate 25.

Figure 9:
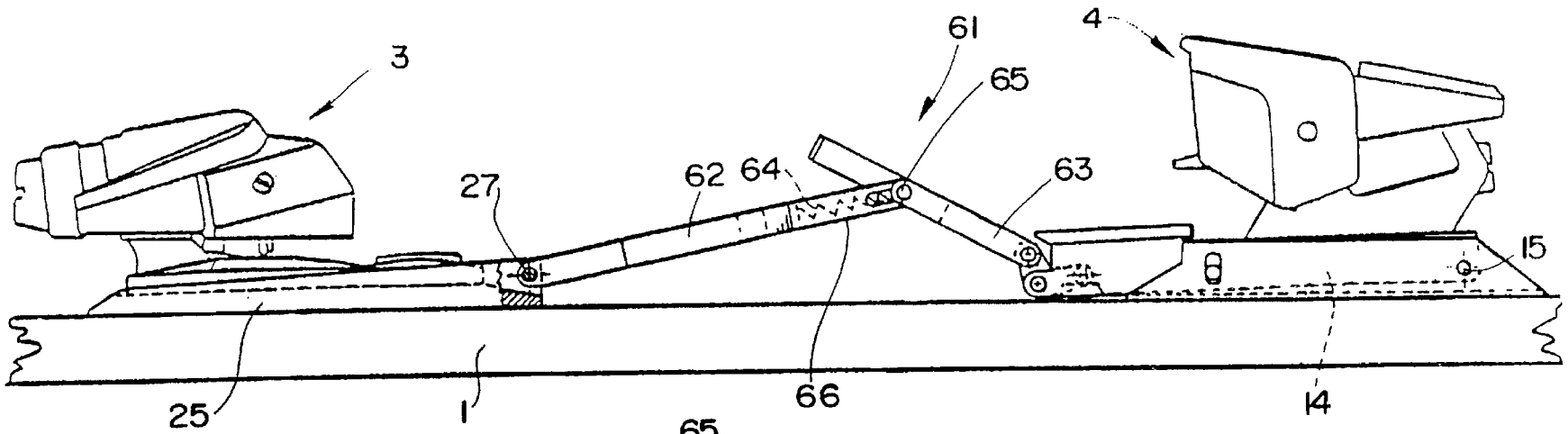
FIG. 9 illustrates, in side elevation, a variation of the invention.

FIG. 9 illustrates another variation of the device according to the invention, according to which front compression bar 61 is obtained in two portions 62 and 63, journalled mutually in their central portion, so as to constitute a sort of knuckle joint.

At rest, compression bar 61 is found in the configuration illustrated in FIG. 9. The knuckle joint is broken, which eliminates any pre-stress in the device, therefore any additional pre-stress in the ski.

When the boot is present, the knuckle joint is flattened, which, in the area of the device, generates the previously discussed resting pre-stress. Advantageously, in the illustrated variation, this pre-stress is additionally generated by springs 64 which act on journal axle 65 between the two portions 62 and 63. To do this, axle 65 is mounted in front portion 62 in the area of a slot 66, which is oriented longitudinally with respect to this portion 62. Four springs 64 are housed in groups of two in portion 62, and push axle 65 towards the rear. The flattening of the knuckle joint causes the displacement of axle 65 in its slot 66 against the return force of springs 64. The springs then induce a pre-stress in front compression bar 61 in the direction of the pivot element, which tends to make slide 14 ascend to its upper position.

Figure 10:
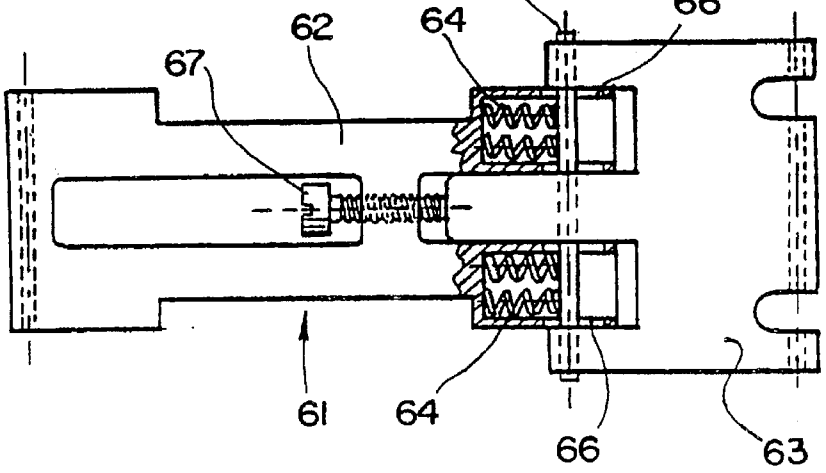
FIG. 10 is a top plan view of an element present in the assembly of FIG. 9.

Advantageously, an abutment is additionally provided to fixedly connect both portions 62 and 63 with respect to one another, along a longitudinal direction, when the knuckle joint is in its flattened position. With reference to FIG. 10, this abutment is constituted by a screw 67, which is engaged in a threaded opening of portion 62, so as to take support against the front end of rear portion 63. In this manner, the frontward horizontal forces induced by the rotation of pivot element 30 in response to downward vertical biases of the boot on support 12, are transmitted to front base plate 25 without causing additional compression of springs 64.

This construction also enables a pre-stress to be induced in the device, and therefore in the ski, only when desired, in particular while skiing. When not skiing, this pre-stress can be canceled by opening the knuckle joint, as is visible in FIG. 9.

It goes without saying that the invention is not limited to the device and to the various aforementioned variations.

In particular, one could turn over pivot element 30, i.e., place pin 37 on the other side towards front element 3, and interchange the position of the journal axles of compression bars 31 and 14 on the pivot element. Likewise, one could inverse the role of the front and rear bindings such that it is the front binding element that is tiltably mounted about an axis, and wherein the front support element constitutes the sensor which captures the downward vertical biases of the boot on the ski.

Likewise, one could implement a sensor independent of the front and rear support elements. Finally, other variations are possible in the area of the linking means between the sensor and the front and rear flexion means.

We claim:

1. An apparatus for modifying the pressure distribution of an alpine ski along a sliding surface of the ski, the ski having a sliding surface, a front end and a rear end, the ski being equipped with a front binding element and a rear binding element for retaining a boot upon the ski, and at least one support element for supporting a sole of the boot, said apparatus comprising:

a sensor element for capturing vertical forces of a portion of the sole of the boot;

a front flexion device adapted to be positioned proximate the front binding element for generating a flexional moment on the front end of the ski, tending to make the front end plunge in a direction toward the sliding surface of the ski by action of a longitudinal force forwardly directed at said front flexion device;

a rear flexion device adapted to be positioned proximate the rear binding element for generating a flexional moment on the rear end of the ski, tending to make the rear end plunge in a direction toward the sliding surface of the ski by action of a longitudinal force rearwardly directed at said rear flexion device;

a linking arrangement connecting said sensor element to said front flexion device and to said rear flexion device, said linking arrangement comprising means for simultaneously transforming said vertical forces captured by said sensor element into said forwardly directed longitudinal force and into said rearwardly directed longitudinal force; and means for mounting said sensor element for downward movement in response to exertion of said vertical forces from the boot, and wherein said means for simultaneously transforming said vertical forces comprises a transmission element for transforming said downward movement captured by said sensor element into a forwardly directed longitudinal force applied to said front flexion device and into a rearwardly directed longitudinal force applied to said rear flexion device, said forwardly and rearwardly directed forces being substantially horizontal and in opposing directions.

2. An apparatus according to claim 1, wherein:

said transmission element comprises an L-shaped pivot element, said pivot element including a horizontal arm and a vertical arm, said linking arrangement further comprising a spacer adapted to be fixed relative to the ski, said horizontal arm having an end resting upon said spacer as said pivot element pivots upon said spacer for transmitting said forwardly and rearwardly directed forces.

3. An apparatus according to claim 2, wherein:

said linking arrangement comprises:

a front compression member connected to said transmission element and extending forwardly from said transmission element to said front flexion device; and a rear compression member connected to said transmission element and extending rearwardly from said transmission element to said rear flexion device.

4. An apparatus according to claim 3, wherein:

said front compression member is connected to an upper end of said vertical arm of said transmission element; and said rear compression member is connected to a lower portion of said vertical arm of said transmission element.

5. An apparatus according to 2, wherein:

said rear flexion device comprises a rear base plate, adapted to be fixed to the ski, said rear base plate having a portion raised with respect to an upper surface of the ski, said raised portion being connected to said linking arrangement; and said spacer is affixed to a front end of said rear base plate.

6. An apparatus according to 2, wherein:

said rear flexion device comprises a rear base plate, adapted to be fixed to the ski, said rear base plate having a portion raised with respect to an upper surface of the ski, said raised portion being connected to said linking arrangement; and said spacer is independent of said rear base plate and is adapted to be affixed to the ski.

7. An apparatus according to claim 1, wherein:

said rear flexion device comprises a rear base plate, adapted to be fixed to the ski, said rear base plate having a portion raised with respect to an upper surface of the ski, said raised portion being connected to said linking arrangement.

8. An apparatus according to claim 1, wherein:

said linking arrangement comprises:

a first compression member connected to said transmission element and extending forwardly from said transmission element to said front flexion device; and a second compression member connected to said transmission element and extending rearwardly from said transmission element to said rear flexion device.

9. An apparatus according to claim 8, wherein:

said rear compression member comprises a top side, said top side comprising means for supporting said body of said rear binding element, a pair of wing members adapted to be attached to the ski and said rear compression member attached to the wing members to allow the rear compression member to slide in relation to the wing members.

10. An apparatus according to claim 8 in combination with said rear binding element, wherein:

said rear binding element comprises a body and a retention element carried by said body; and said rear compression member comprises a top side, said top side comprising means for supporting said body of said rear binding element, a pair of wing members adapted to be attached to the ski and said rear compression member attached to the wing members to allow the rear compression member to slide in relation to the wing members.

11. An apparatus according to claim 8, wherein:

said rear compression member is connected to said raised portion of said rear base plate by means of a journal.

12. An apparatus according to claim 8, wherein:

said rear compression member comprises a front end, said front end of said rear compression member bearing said sensor element, said sensor element constituting a support element for the rear binding element.

13. An apparatus according to claim 8 in combination with said rear binding element, wherein:

said sensor element supports a rear portion of the sole of the boot at said rear binding element; and said rear compression member comprises a front end, said front end of said rear compression member bearing said support element.

14. An apparatus according to claim 8, wherein:

one of said first compression member and said second compression member comprises two segments, said two segments being connected by means of a transverse journal in a central portion of said compression member, said two segments and journal forming a knuckle joint.

15. An apparatus according to claim 1 in combination with said ski.

16. An apparatus according to claim 1 in combination with the front binding element and the rear binding element, wherein:

said front flexion device is adapted to be positioned in the vicinity of the front binding element and said rear flexion device is adapted to be positioned in the vicinity of the rear binding element.

17. An apparatus according to claim 1, wherein:

said front flexion device further comprises a portion upon which the front binding element is adapted to be supported; and said rear flexion device further comprises a portion upon which the rear binding element is adapted to be supported.

18. An apparatus according to claim 1, wherein:

said front flexion device comprises a front base plate for attachment to the ski and for supporting the front binding element; and said rear flexion device comprises a rear base plate for attachment to the ski and for supporting the rear binding element.

19. An apparatus according to claim 1, further comprising:

means separate from said sensor for supporting at least one of the binding elements.

20. An apparatus for modifying the pressure distribution of an alpine ski along a sliding surface of the ski, the ski having a sliding surface, a front end and a rear end, the ski being equipped with a front binding element and a rear binding element for retaining a boot upon the ski, and at least one support element for supporting a sole of the boot, said apparatus comprising:

a sensor element for capturing vertical forces of a portion of the sole of the boot;

a front flexion device adapted to be positioned proximate the front binding element for generating a flexional moment on the front end of the ski, tending to make the front end plunge in a direction toward the sliding surface of the ski by action of a longitudinal force forwardly directed at said front flexion device;

a rear flexion device adapted to be positioned proximate the rear binding element for generating a flexional moment on the rear end of the ski, tending to make the rear end plunge in a direction toward the sliding surface of the ski by action of a longitudinal force rearwardly directed at said rear flexion device;

a linking arrangement connecting said sensor element to said front flexion device and to said rear flexion device, said linking arrangement comprising means for simultaneously transforming said vertical forces captured by said sensor element into said forwardly directed longitudinal force and into said rearwardly directed longitudinal force; and wherein said front flexion device comprises a front base plate, adapted to be fixed to the ski, said front base plate having an upper surface, said upper surface having a mounting zone for supporting a base of the front binding element, said front base plate further having a rear end for receiving said forwardly directed longitudinal force.

21. An apparatus according to claim 20, wherein:

said front base plate comprises a rear edge;

said front flexion device comprises, in an area of said rear end of said front base plate, a pivot element and a transverse axle for journalling said pivot element about a transverse axis, said pivot element comprising a free end engaged beneath said rear edge of said front base plate; and said pivot element is connected to said linking arrangement.

22. An assembly including an apparatus for modifying the pressure distribution of an alpine ski along a sliding surface of the ski, said assembly comprising:

an alpine ski having a sliding surface, a front end and a rear end;

a front binding element and a rear binding element both connected to said ski for retaining a boot upon the ski, and at least one support element connected to said ski for supportingly engaging a portion of a sole of the boot said support element being fixed with respect to an upper surface of said ski;

a sensor element for capturing vertical forces of a further portion of the sole of the boot;

a front flexion device adapted to be positioned proximate the front binding element for generating a flexional moment on the front end of the ski, tending to make the front end plunge in a direction toward the sliding surface of the ski by action of a longitudinal force forwardly directed at said front flexion device;

a rear flexion device adapted to be positioned proximate the rear binding element for generating a flexional moment on the rear end of the ski, tending to make the rear end plunge in a direction toward the sliding surface of the ski by action of a longitudinal force rearwardly directed at said rear flexion device;

a linking arrangement connecting said sensor element to said front flexion device and to said rear flexion device, said linking arrangement comprising means for simultaneously transforming said vertical forces captured by said sensor element into said forwardly directed longitudinal force and into said rearwardly directed longitudinal force.

23. An apparatus for modifying the natural pressure distribution of an alpine ski along a sliding surface of the ski, the ski having a sliding surface, a front end and a rear end, the ski being equipped with a front binding element and a rear binding element for retaining a boot upon the ski, and at least one support element for supporting a sole of the boot, said apparatus comprising:

a sensor element mounted for vertical movement and for capturing vertical forces exerted by at least a portion of the sole of the boot;

a front base plate and a rear base plate adapted to be affixed to the ski;

a front compression member connected to said front base plate and a rear compression member connected to said rear base plate;

a linkage pivot element;

a pivot connection between said linkage pivot element and said sensor that causes pivotal movement of said linkage pivot element in response to said vertical movement of said sensor;

a connection between said linkage pivot element and said front compression member that causes forward movement of said front compression member in response to said pivotal movement of said linkage pivot; and a connection between said linkage pivot element and said rear compression member that causes rearward movement of said rear compression member in response to said pivotal movement of said linkage pivot.

24. An apparatus according to claim 23, wherein:

said sensor element is affixed to one of said front compression member and said rear compression member;

said one of said front compression and said rear compression member being journalled to a respective one of said front and rear base plates.

25. An apparatus according to claim 24, wherein:

said sensor element is affixed to said rear compression member.

26. An apparatus according to claim 24, wherein:

said linkage pivot element comprises an L-shape, said linkage pivot element including a horizontal arm and a vertical arm, said linking arrangement further comprising a spacer adapted to be fixed relative to the ski, said horizontal arm having an end resting upon said spacer, and each end of said vertical arm is connected to a respective one of said front compression member and said rear compression member.

27. An apparatus according to claim 26, wherein:

said front compression member is connected to an upper end of said vertical arm of said linkage pivot element; and said rear compression member is connected to a lower end of said vertical arm of said linkage pivot element.

28. An apparatus according to claim 26, wherein:

said spacer is affixed to a front end of said rear base plate.

29. An apparatus according to claim 28, wherein:

said spacer is independent of said rear base plate and adapted to be affixed to the ski in front of said rear base plate.

30. An apparatus according to claim 23, wherein:

said front base plate is has an upper surface, said upper surface having a mounting zone for supporting a base of the front binding element, said front base plate further having a raised rear end to which said front compression member is connected.

31. An apparatus according to claim 23, wherein:

said front base plate comprises a rear edge;

said apparatus further comprising, in an area of said rear end of said front base plate, a pivot element and a transverse axle for journalling said pivot element about a transverse axis, said pivot element comprising a free end engaged beneath said rear edge of said front base plate.

32. An apparatus according to claim 23, wherein:

said rear compression member comprises a slide for receiving a body of the rear binding element.

33. An apparatus according to claim 23, wherein:

one of said first compression member and said second compression member comprises two segments, said two segments being connected by means of a transverse journal in a central portion of said compression member, said two segments and journal forming a knuckle joint.

34. An apparatus according to claim 23 in combination with said ski, said front binding element, and said rear binding element.

35. An apparatus according to claim 23 in combination with said ski.

* * * * *